United States Patent [19]

Lövgren

[11] Patent Number: 4,630,552

[45] Date of Patent: Dec. 23, 1986

[54] DEVICE AT COMBUSTION PLANTS FOR AUTOMATICAL FEEDING OF FUELS WITHIN THE FIREPLACE OF THE PLANT

[75] Inventor: Anders Lövgren, Skellefteå , Sweden

[73] Assignee: AB Megaron, Skelleftea, Sweden

[21] Appl. No.: 776,628

[22] Filed: Sep. 16, 1985

[51] Int. Cl.[4] ..... F23H 5/02

[52] U.S. Cl. ..... 110/190; 110/101 C; 110/101 CA; 110/186

[58] Field of Search ..... 110/190, 101 CA, 186, 110/188, 101 C

[56] References Cited

U.S. PATENT DOCUMENTS

| | | | |
|---|---|---|---|
| 1,920,572 | 8/1933 | Lacke | 110/101 CA |
| 2,058,945 | 10/1936 | Barnett | 110/101 CA |
| 2,215,067 | 9/1940 | Denison et al. | 110/101 CA |
| 3,301,715 | 1/1967 | Gerrard et al. | 431/80 X |
| 4,080,784 | 3/1978 | Jubb | 110/101 CA X |
| 4,315,468 | 2/1982 | Tyer et al. | 110/190 X |
| 4,517,902 | 5/1985 | Christian | 110/190 |

*Primary Examiner*—Edward G. Favors

*Attorney, Agent, or Firm*—Burns, Doane, Swecker & Mathis

[57] ABSTRACT

A method and device in combustion plants for solid fuels with a movable grate means for feeding the fuel through the fireplace of the combustion plant, for the control of the fuel feed through the fireplace of the plant. To control that the fed fuel is completely combusted when discharged from the fireplace of the plant the degree of combusted fuel is sensed by a sensor means (9) in a zone (B) at the end of the movable grate means (1) in order to obtain a control signal to the drive means of the grate means.

3 Claims, 1 Drawing Figure

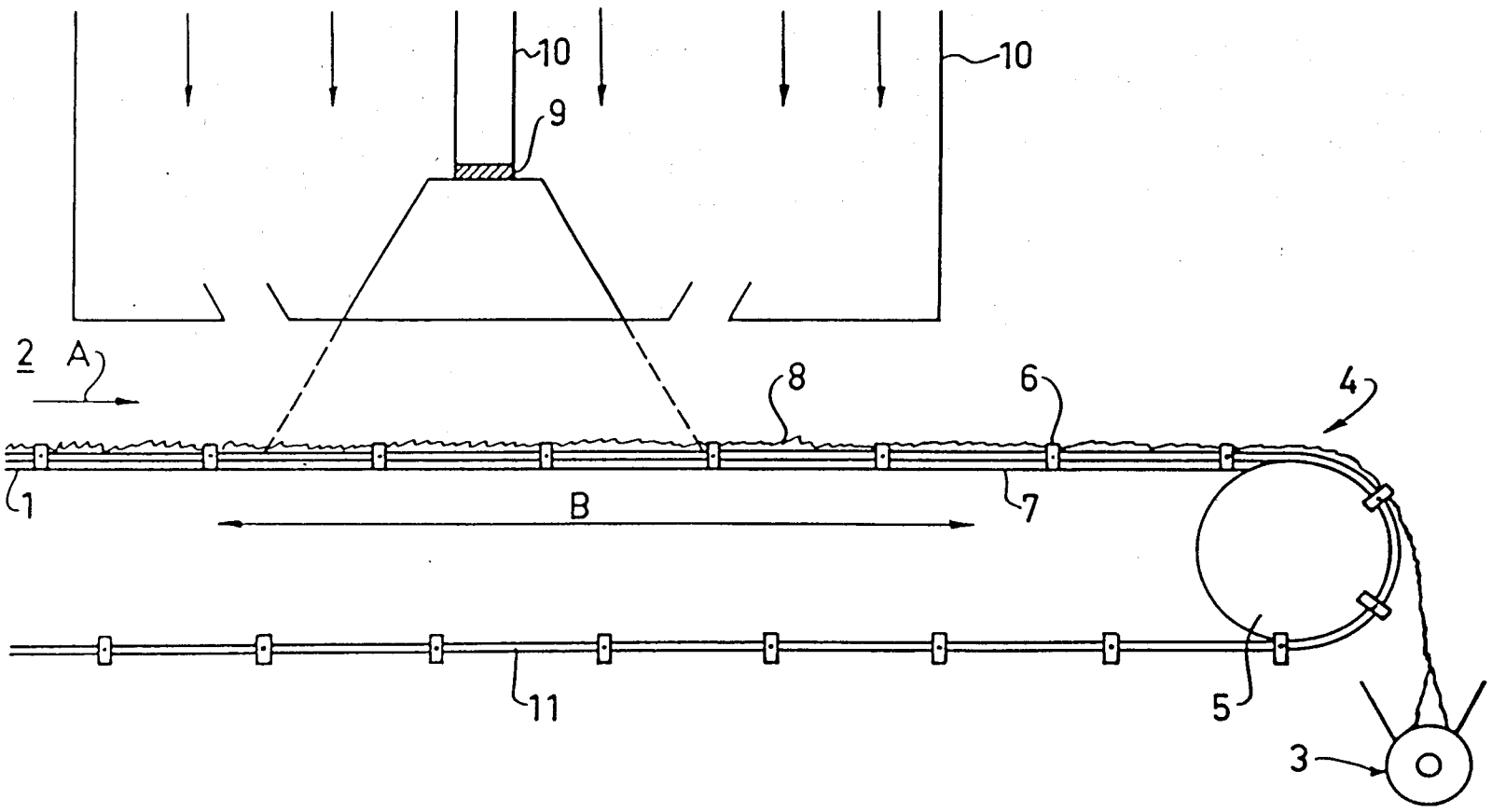
10
10
9
2
A
1
8
6
7
B
4
5
3
11

DEVICE AT COMBUSTION PLANTS FOR AUTOMATICAL FEEDING OF FUELS WITHIN THE FIREPLACE OF THE PLANT

BACKGROUND AND OBJECT OF THE PRESENT INVENTION

This invention relates to a method and device at a combustion plant for solid fuels provided with a movable grate means for the control of the fuel feed within the fire space of the combustion plant in order to obtain an efficient and complete combustion of the fuel.

In combustion plants with a movable grate means, on which the fuel is fed through the fire space of the combustion plant, the fuel is fed at a substantially constant velocity into and through the fire space, where the combustion takes place through the supply of primary as well as secondary combustion air, but due to variations in fuel amount fed per unit of time and in the very fuel as to dryness and also combustibility it has been found to involve great problems to obtain such an efficient and complete combustion process in combustion plants with a movable grate means that the fuel is completely burnt out when it leaves the fire space of the plant.

Consequently it is the object of this invention to eliminate this problem and to achieve a method and a device for control of the fuel feed through the fire space of a combustion plant provided with a movable grate means, said space automatically providing for a complete combustion of fed fuel independently of variations in fuel amount fed per unit of time and in the nature of the fed fuel as to dryness and other factors which may influence the combustion negatively.

THE DRAWING

The invention will be described in the following more in detail with reference to the enclosed drawing in which a device according to the invention is shown schematically.

DETAILED DESCRIPTION OF THE PREFERRED EMBODIMENT OF THE INVENTION

On the drawing 1 designates a grate means included in a combustion plant for solid fuels, by which fuel is fed in the direction marked by the arrow A on the drawing through the fireplace 2 of the combustion plant from a fuel supply opening not shown on the drawing to an ashes/slag discharge device 3 at the discharge end 4 of the movable grate means. In the illustrative example shown on the drawing the grate means 1 consists of a grate comprising scraper means 6 arranged between endless chains 11 driven over end rolls 5 and feeding the fuel over a fixed grate bottom 7, but the invention is of course not limited to such a grate means but can be used with any type of moving grate or other grate means conveying fuel through the fireplace simultaneously as it is combusted, the primary combustion air being supplied preferably from below and through the fuel bed 8 fed on and by the grate means, while the secondary combustion air is introduced in the fire space above the grate means.

In accordance with the invention a sensor means 9 is arranged above the grate means 1 in a control zone B located in the vicinity of, and upstream of, the discharge end of the grate means 1, said sensor means 9 being directed towards the grate means 1 and the fuel bed thereon of completely and/or partly burnt-out fuel for sensing the state of the fuel in the control zone, i.e. if the fuel being in the control zone B is completely or only partly burnt out and has been converted into ashes/slag in a sufficient degree.

For this sensing the sensor means 9 is arranged to meausre and register IR-radiation from temperature or color of the fuel hearth in the control zone B or air temperature above the fuel hearth, i.e. the temperature of the air in the air space between the sensor means and the fuel hearth more or less burnt out in the control zone B. The sensor means 9 is further arranged, on the basis of the values thus obtained, which give an almost exact measure of the combustion degree of the fuel in the control zone B, to emit a control signal to the drive means of the grate means not shown in the drawing for adjustment of the feeding movement of the grate means in dependence of the state of the fuel placed in the control zone B. This feeding movement can be continuous or discontinous. The control signal from the sensor means 9 to the drive means can preferably be embodied so that it comes periodically and has a length providing a motion of the fuel from nil up to so many millimeters corresponding to the range covered by the sensor means.

The sensor means 9 can e.g. consist of an IR-detector with a scattering lens, by which a sensing range of the fuel bed is obtained which is oblong-rectangular and extends across the whole bed. A color or temperature detector may of course also be used as sensor means.

Measuring air can advantageously be supplied to the control zone B in order to obtain a final combustion of fuel rests in said zone, if this has not already taken place, and as an unambiguous indication of the fact that the fuel is completely burnt out. Supply of air to the completely or partly burnt out fuel hearth in the control zone will cause an increase of the temperature if a final combustion has not taken place and a decrease if the fuel is already completely burnt out, i.e. finally burnt.

In order to protect the sensor means 9 this is preferably arranged in a protective pipe 10 which can be simultaneously utilized for supply of air to the control zone in such a way that cleaning off and cooling of the sensor means 9 are obtained.

The invention is not limited to what has been shown on the drawing and described above but can be changed and modified in several different manners within the scope of the inventive thought indicated in the claims.

I claim:

1. A method for feeding solid fuel through a fireplace of a combustion plant, comprising the steps of:

positioning solid fuel on a fuel-receiving end of movable grate means, advancing said movable grate means through said fireplace from said fuel-receiving end to a fuel-discharging end of said grate means, while combusting the fuel disposed thereon, said grate means being advanced through a sensing zone of said fireplace disposed in the vicinity of, and upstream of, said fuel-discharging end, conducting a supply of measuring air to fuel disposed on said grate means in said sensing zone, such that the temperature of incompletely combusted fuel increases and the temperature of completely combusted fuel decreases, sensing the temperature of the fuel in said sensing zone to obtain an indication of the extent of combustion thereof, and adjusting the rate of advance of said grate means in accordance with the sensed temperature in a manner tending to achieve a complete combustion of the fuel.

2. Apparatus for feeding solid fuel through a fireplace of a combustion plant, said apparatus comprising:

a fireplace, a movable grate means disposed in said fireplace for conducting solid fuel from a fuel-receiving end to a fuel-discharging end of said grate means, while said fuel is combusted, said grate means arranged to pass through a sensing zone of said fireplace disposed in the vicinity of, and upstream of, said fuel-discharging end, means for conducting a supply of measuring air to fuel disposed on said grate means in said sensing zone, such that the temperature of incompletely combusted fuel increases and the temperature of completely combusted fuel decreases, means for sensing the temperature of the fuel in said sensing zone to obtain an indication of the extent of combustion thereof, so that the rate of advance of said grate means can be adjusted in accordance with the sensed temperature in a manner tending to achieve a complete combustion of the fuel.

3. Apparatus according to claim 2 including a protective pipe disposed above said grate, said sensing means disposed in said pipe, and means for conducting air through said pipe to cool and clean said sensing means.

* * * * *